US005168912A

United States Patent [19]

Jelic et al.

[11] Patent Number: 5,168,912

[45] Date of Patent: Dec. 8, 1992

[54] OPERABLE ARCH WINDOW BLIND

[75] Inventors: Ralph Jelic, Butler County; Ren Judkins, Allegheny County, both of Pa.

[73] Assignee: Verosol USA Inc., Pittsburgh, Pa.

[21] Appl. No.: 683,866

[22] Filed: Apr. 11, 1991

[51] Int. Cl.[5] ..... E06B 9/06

[52] U.S. Cl. ..... 160/84.1; 160/134

[58] Field of Search ..... 160/84.1, 134, 368.1

[56] References Cited

U.S. PATENT DOCUMENTS

| | | | |
|---|---|---|---|
| 190,348 | 5/1877 | May | 160/134 |
| 451,068 | 4/1891 | Park . | |
| 823,096 | 5/1906 | Armstrong . | |
| 1,512,252 | 10/1924 | Verduin . | |
| 1,609,877 | 12/1926 | Kendall . | |
| 3,134,426 | 5/1964 | Cherubin | 160/81 |
| 4,699,195 | 10/1987 | Lester | 160/134 |
| 4,776,380 | 11/1988 | Lester | 160/134 |
| 4,802,523 | 2/1989 | Scholten et al. | 160/368.1 X |
| 4,825,611 | 5/1989 | Bassett | 160/372 |
| 4,858,669 | 8/1989 | Vinson | 160/84.1 X |
| 4,934,436 | 6/1990 | Schnebly | 160/84 |
| 5,002,112 | 3/1991 | Schebley et al. | 160/84.1 |

*Primary Examiner*—Blair M. Johnson

*Attorney, Agent, or Firm*—Buchanan Ingersoll

[57] ABSTRACT

A collapsible blind for use in arch-shaped windows. The pleated blind design employs a flexible adhesive with optional link as shown on the bottom of the blind. A simple slotted hinge pivotally connects bars attached to the opposite end of the blind. The blind is easily assembled, relatively inexpensive to produce and requires no external supports.

17 Claims, 7 Drawing Sheets

OPERABLE ARCH WINDOW BLIND

BACKGROUND OF THE INVENTION

1. Field of the Invention

This invention relates generally to the field of blinds for use in windows and more particularly to collapsible blinds for use in arch-shaped windows.

2. Description of the Prior Art

Many buildings have windows that are arch shaped. Often it is desirable to prevent sunlight from directly entering the building through these arch windows. For these reasons, a number of blinds suitable for arched windows have been developed. Some designs such as are shown in U.S. Pat. No. 4,776,380 to Lester use venetian blinds. Venetian blinds have many slats making them relatively difficult to assemble, opaque and of distinctive appearance.

Simpler designs employ pleated material rather than venetian blind slats. Some pleated material designs use curved round rods such shown in U.S. Pat. No. 1,609,877 to Kendall. Other designs require that supports be affixed into the window structure. These supports can be a plurality of hooks as shown in U.S. Pat. No. 4,825,611 to Basset or a mounting block as shown in U.S Pat. No. 4,934,436 to Schnebly.

It would be desirable to construct a simplified blind for arched windows that used pleated blind material and did not have many visible support rods, support hooks, cords or other readily noticeable support structure. Preferably, the blind should have no support rods or support hooks. The blind should be low cost, reliable, easy to assemble and easy to operate. Preferably, the blind should be capable of remote operation such as through use of a pull cord.

SUMMARY OF THE INVENTION

The present invention provides a blind for arched shaped windows. The simple construction of the present invention allows for a relatively inexpensive production and easy assembly. Furthermore, the present invention has no holes or curved rods in the light space that could cause shadows or light leaks. Moreover, our blind can be remotely operated. A track is preferably provided to carry the blind and give circumferential support, particularly for larger blinds.

DESCRIPTION OF THE PREFERRED EMBODIMENTS

Figure 1:
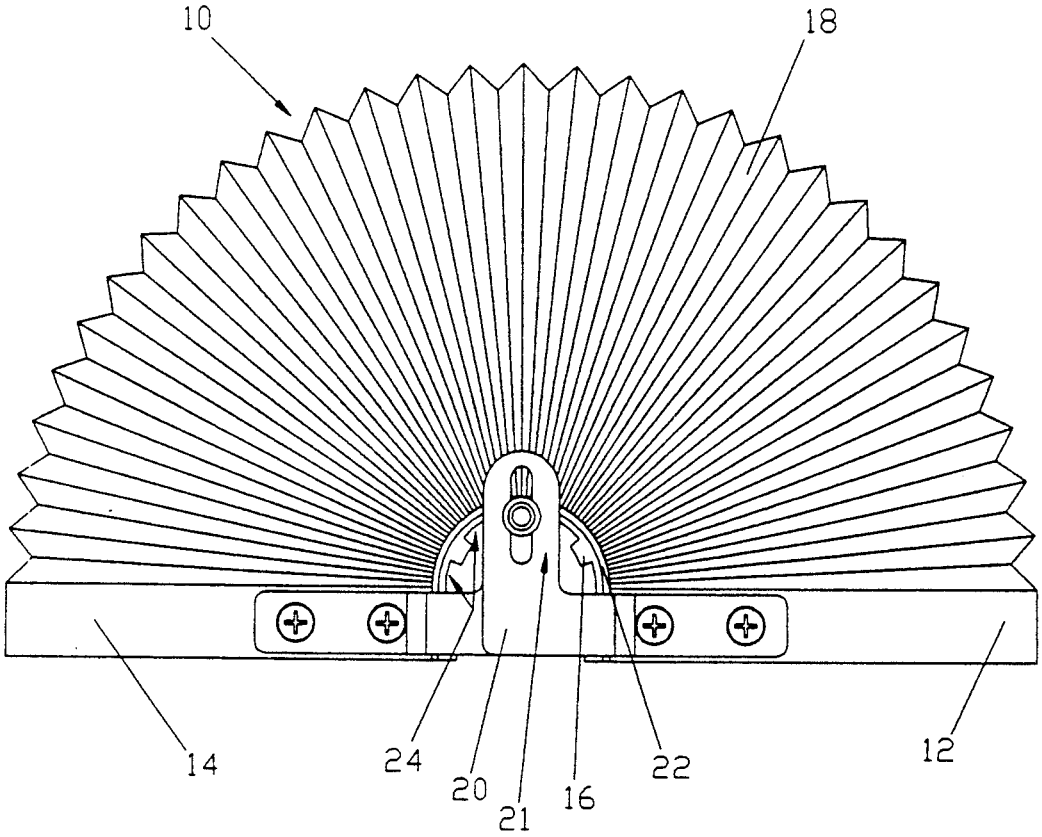
FIG. 1 shows a back view of a present preferred embodiment in an open position.
Figure 2:
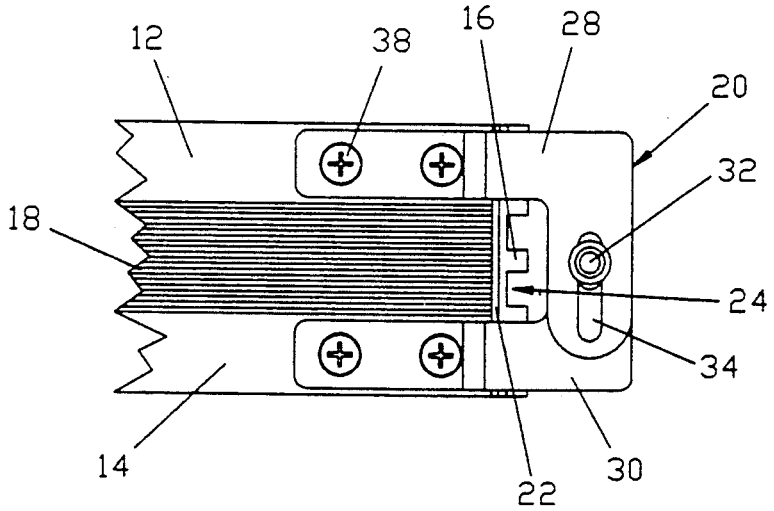
FIG. 2 shows a back view of the present preferred embodiment of FIG. 1 with the blind assembly being in a stacked position and partially cut away.
Figure 6:
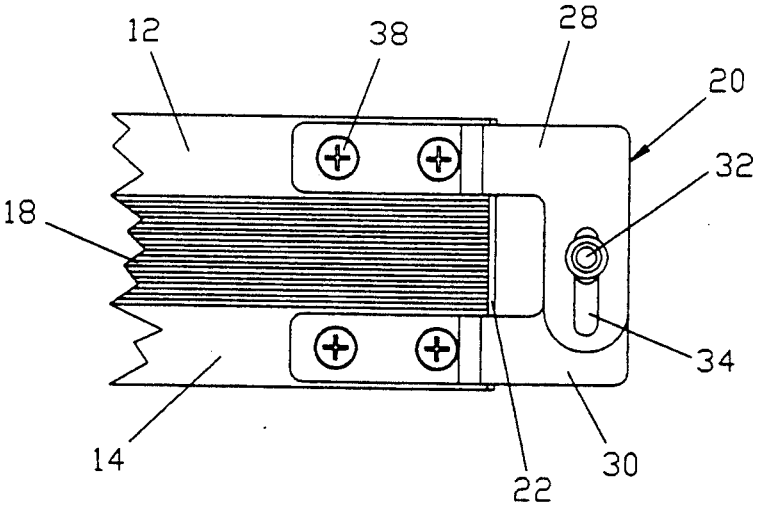
FIG. 6 is a back view similar to FIG. 2 of a second preferred embodiment of our blind.

Referring first to FIGS. 1 and 2, a preferred embodiment of a fan shaped blind assembly is designated generally at 10. Blind 10 has a first bar 12 and a second bar 14. A flexible link 16 is fixed at one end to first bar 12 and at its opposite end to second bar 14. The underside of flexible link 16 which faces away from first bar 12 and second bar 14, has a plurality of spaced grooves 24 lying perpendicular to the length of flexible link 16. Particularly suitable for flexible link 16 is a reinforced rubber strip of the type which has been used for an automotive timing belt. A pleated or honeycomb blind panel 18 lies between first bar 12 and second bar 14 and atop flexible link 16. One side of blind panel 18 is fixed to first bar 12. The opposite side of blind panel 18 is fixed to second bar 14 and the bottom of blind panel 18 is fixed to flexible link 16 by a flexible adhesive 22. A pivot means 20 is connected to the bottom of first bar 12 and second bar 14. When in the closed position, as shown in FIG. 2, pleated blind panel 18 collapses as the second bar 14 moves arcuately toward the first bar or vice versa. In this closed position flexible link 16 has a straight orientation. As first bar 12 and second bar 14 move arcuately away from one another, as is shown best in FIG. 1, blind panel 18 opens and flexible link 16 curves to an arch shaped position. The flexible adhesive 22 increases the stability of blind assembly 10 while maintaining the flexibility of blind panel 18 during operation. Particular success has been found in the use of silicone-based adhesives. Permatex Black RTV silicone adhesive sealant, Dow Corning RTV Sealant 732 and Loctite Superflex silicone adhesive sealant have worked well. We have also found that these adhesives can be used without the flexible link 16 to create a second preferred embodiment shown in FIG. 6. This embodiment otherwise has all of the elements as the embodiment in the previous figures. The use of adhesive 22 without link 16 allows me to simplify assembly of a smaller pleated or tabbed shade and shades made with honeycomb material which have greater inherent stability and stacking memory.

Figure 3:
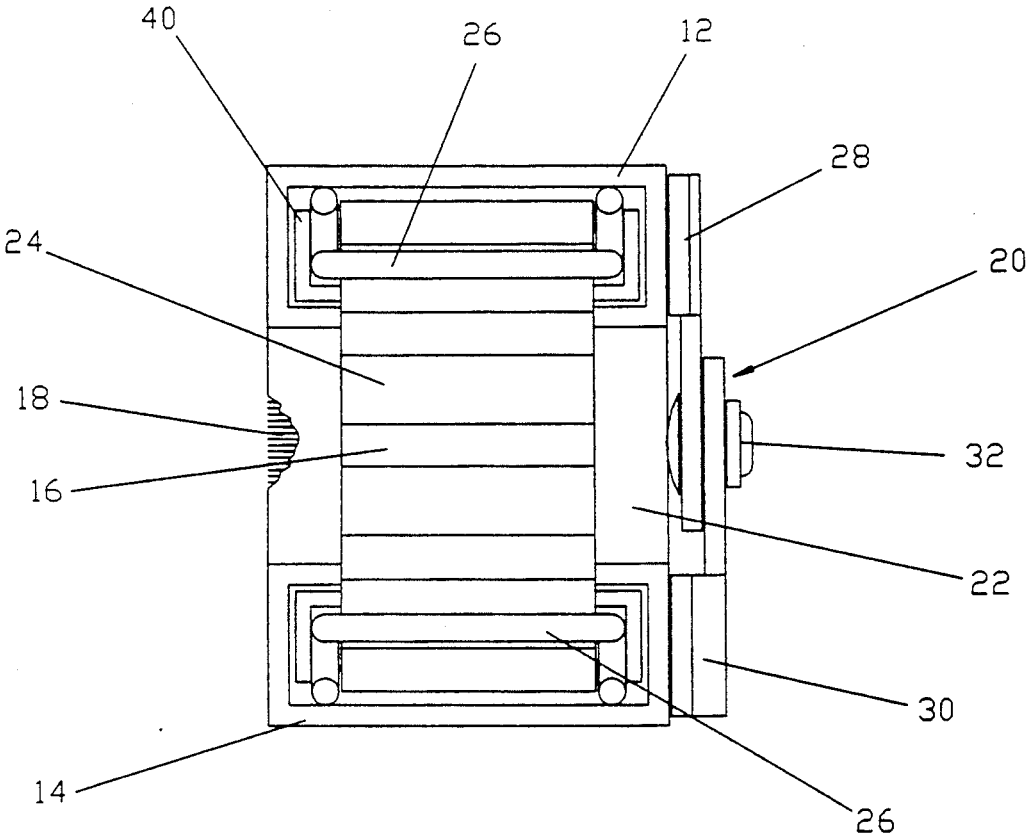
FIG. 3 shows an end view of the embodiment of FIG. 1.
Figure 4:
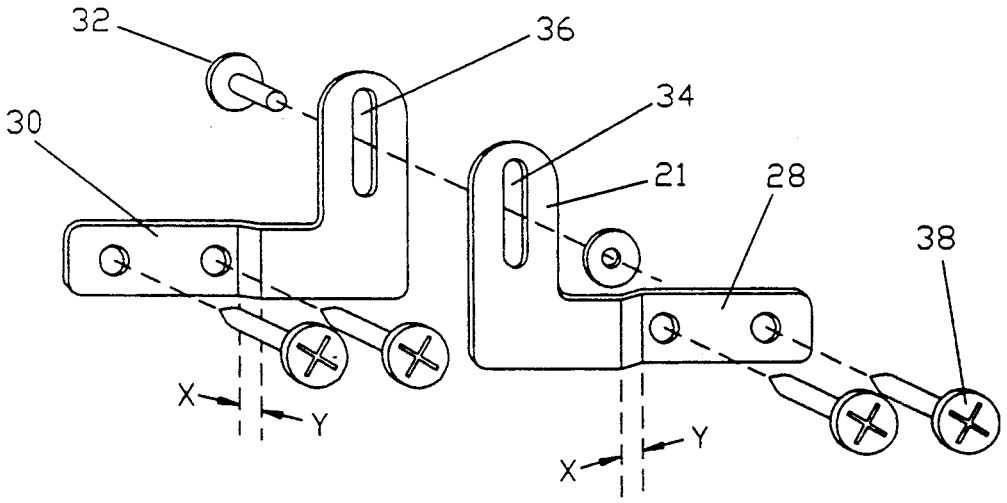
FIG. 4 shows an exploded view of a preferred pivot means.

Referring next to FIGS. 2, 3 and 4, a preferred pivot means is designated generally at 20. A first hinge segment 28 is generally flat and L-shaped having an oval slot 34 lying on a portion of first hinge segment 28. A portion of first hinge segment 28 opposite the portion having oval slot 34 lies against and is fixed to first bar 12 in any convenient manner such as by the use of screws 38. A second hinge segment 30 is generally L-shaped and has an oval slot 36. A portion of each hinge segment 30 and 28 lying opposite from oval slot 36 is flat and lies against and is fixed to second bar 14 in any convenient manner such as by the use of screws 38. A portion of second hinge segment 30 designated by "x" and "y" respectively on FIG. 4, is curved so that the portion of the hinge segments having an oval slot 36 lies on a different plane than does the portion of the hinge segment that is fixed to the bar. When first hinge segment 28 and second hinge segment 30 are properly positioned and fixed to first bar 12 and second bar 14, respectively, the portions of first hinge segment 28 having slot 34 and second hinge segment 30 having slot 36 lie against one another with slots 34 and 36 overlapping somewhat. With first hinge segment 28 and second hinge segment 30 being in such position, there exists a space common to slots 34 and 36 that can accommodate a pin 32. With pin 32 positioned within slots 34 and 36, first hinge segment 28 can rotate about pin 32 relative to second hinge segment 30 and, thus, first bar 12 can move angularly relative to second bar 14. The oval shape of slots 34 and 36 provide pivot means 20 with an ability to accommodate a greater amount of blind panel 18 in blind apparatus 10. By being able to slide outward along the length of oval slots 34 and 36, pivot means 20 can widen, thus enabling the same pivot means 20 to be used for a variety of sizes of blinds. This sliding feature also allows the blinds to accommodate slightly non-circular motion for arch windows that are not perfect half circles. Because the pivot 20 is in a plane parallel to and adjacent the blind, the upright leg 21 and the head of pin 32 will provide support for the fabric. We have also found that one can cause the fabric to tilt relative to the bars 12 and 14 by bending leg 21 toward the fabric. Although the preferred embodiment of pivot means 20 as shown in FIG. 3 includes a curved portion "x" and "y" in both hinge segments 30 and 28, the curved portion "x" might not be present instead only the second hinge segment may be curved.

Figure 5:
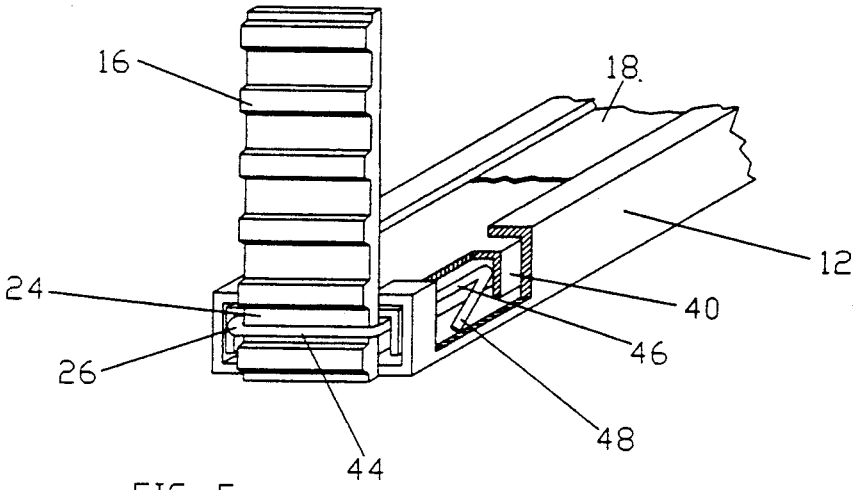
FIG. 5 shows a partially cut away perspective of a preferred means of fixing the flexible link to the first and second bars.

Flexible link 16 can be fixed to first bar 12 and second bar 14 by any convenient means. FIG. 5 shows the preferred method of fixing flexible link 16 to first bar 12. First bar 12 is constructed to have hollow cavities. Preferably, a plastic insert 40 shaped to fit snugly within first bar 12 is inserted into the space within first bar 12. Plastic insert 40 will thus be fixed within the first bar. Plastic insert 40 will be designed to have recesses 42 along each of its sides. With flexible link 16 in position, a U-shaped clip 26 will be inserted over flexible link 16 and will enter the space within first bar 12 and plastic insert 40. Clip 26 has a flat portion 44 and two parallel portions 46 extending out from flat portion 44. Flat portion 44 will lie over flexible link 16 within a groove 24. Each parallel extending portion 46 will be straight except for a curved portion 48. When clip 26 is inserted within first bar 12, the parallel portions 46 will lie against plastic insert 40 and curved section 48 will extend into recess 42 acting to secure clip 26 within first bar 12. Similarly, flexible link 16 will be secured to second bar 14 in this same manner. Using clip 26 to secure flexible link 16 to bars 12 and 14 offers a strong connection which could be uncoupled if desired. Thus, clip 26 offers a securing means that will prevent slippage of flexible link 16 relative to bars 12 and 14. It should also be apparent that this arrangement can be used for any size blinds by simply changing the length of flexible link 16.

Variations of the preferred embodiment disclosed could be made without departing from the spirit of the invention. For example, pivot means 20 as described could be used on both the front and back of first bar 12 and second bar 14 thus offering increased overall stability of the blind assembly.

Figure 7:
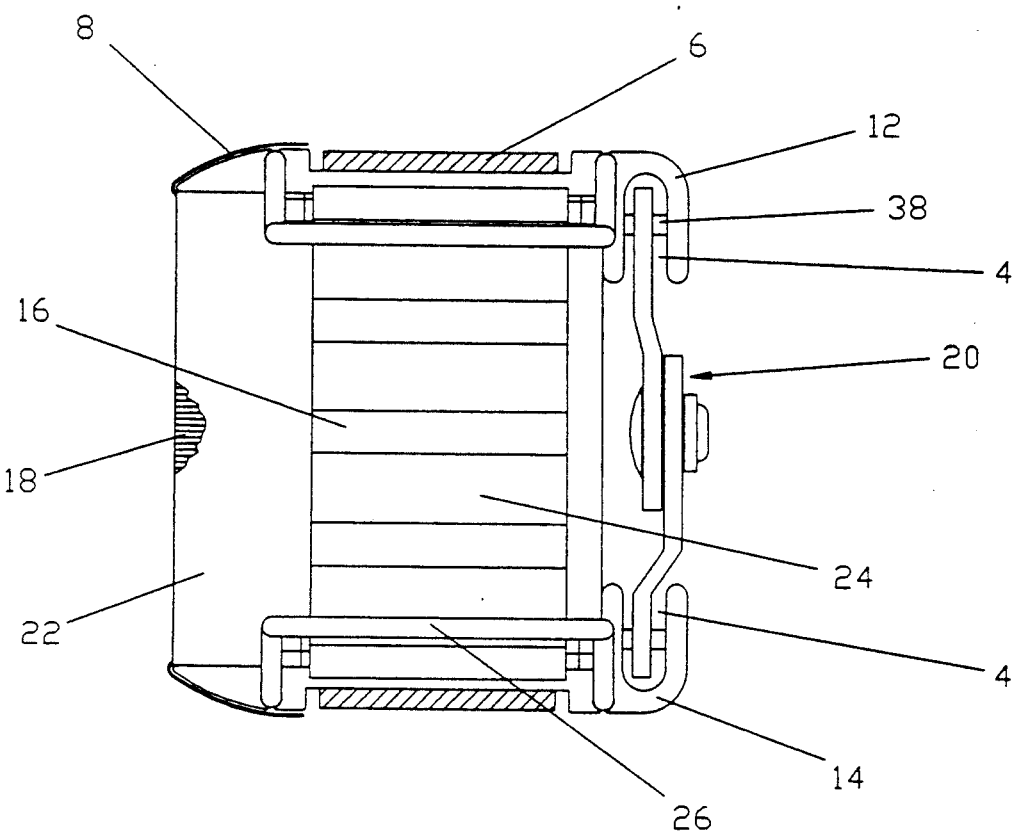
FIG. 7 is a bottom view partially cut away of a third preferred embodiment of our blind.

In a third preferred embodiment shown in FIG. 7, we provide a recess 4 in bars 12 and 14 to receive pivot means 20. This arrangement gives bars 12 and 14 a continuous, smooth outer face. We also extend the blind fabric 18 so that fabric panels 8 are bonded to the exterior face of rails 12 and 14 as well as to the interior face adjacent the fabric 18 as shown in FIG. 5. In this embodiment we also provide a magnet or magnetic tape 6 on the bottom of rails 12 and 14 for attachment to a metal window frame (not shown). The magnet may be recessed into the rails as shown. This embodiment utilizes flexible link 16 attached to the rails by clips 26. It is not necessary that the link 16 extend across the full pleat width of fabric 18. However, we prefer that the adhesive 22 extend across the full pleat with as shown.

Figure 8:
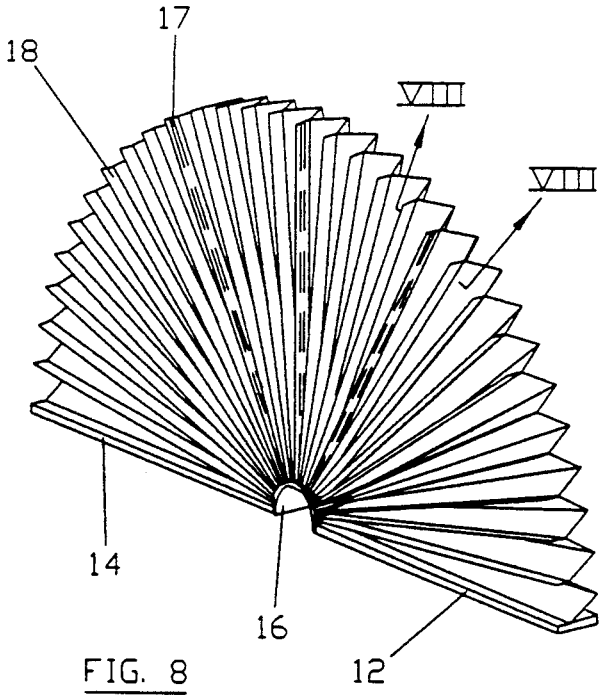
FIG. 8 is a rear perspective view showing another embodiment with optional support rods and no pivot.
Figure 9:
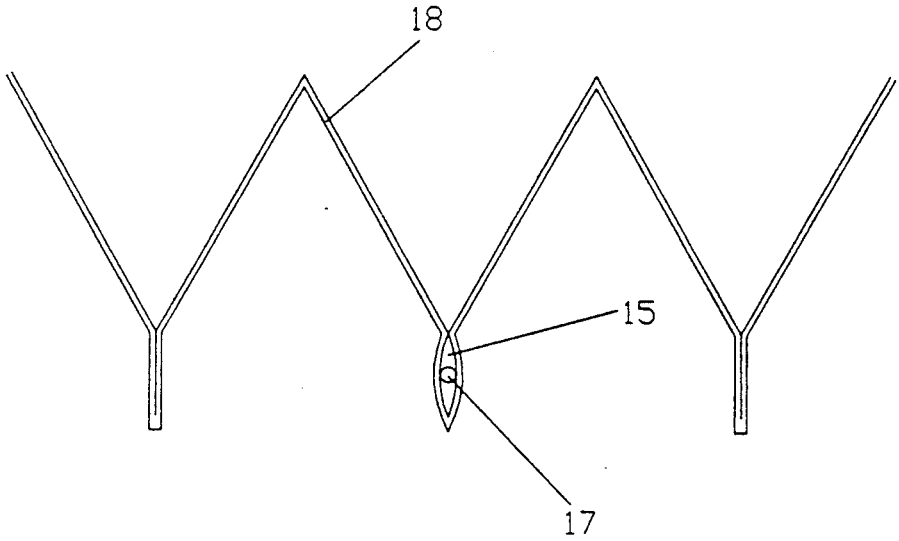
FIG. 9 is a sectional view taken along the lines VIII—VIII of FIG. 8.

As shown in FIGS. 8 and 9, we can optionally provide support rods 17 placed in pockets 15 in fabric 18. Because these rods are aligned with the pleats in fabric 18, they are not readily visible. Preferably, these rods are not attached to the flexible link 16. Rather the rods are placed in pockets 15 closed at the pivot end of the fabric 18 by the adhesive 22. These support rods 17 prevent the fabric from folding or collapsing in a direction transverse to the plane through which the fabric 18 travels.

Figure 10:
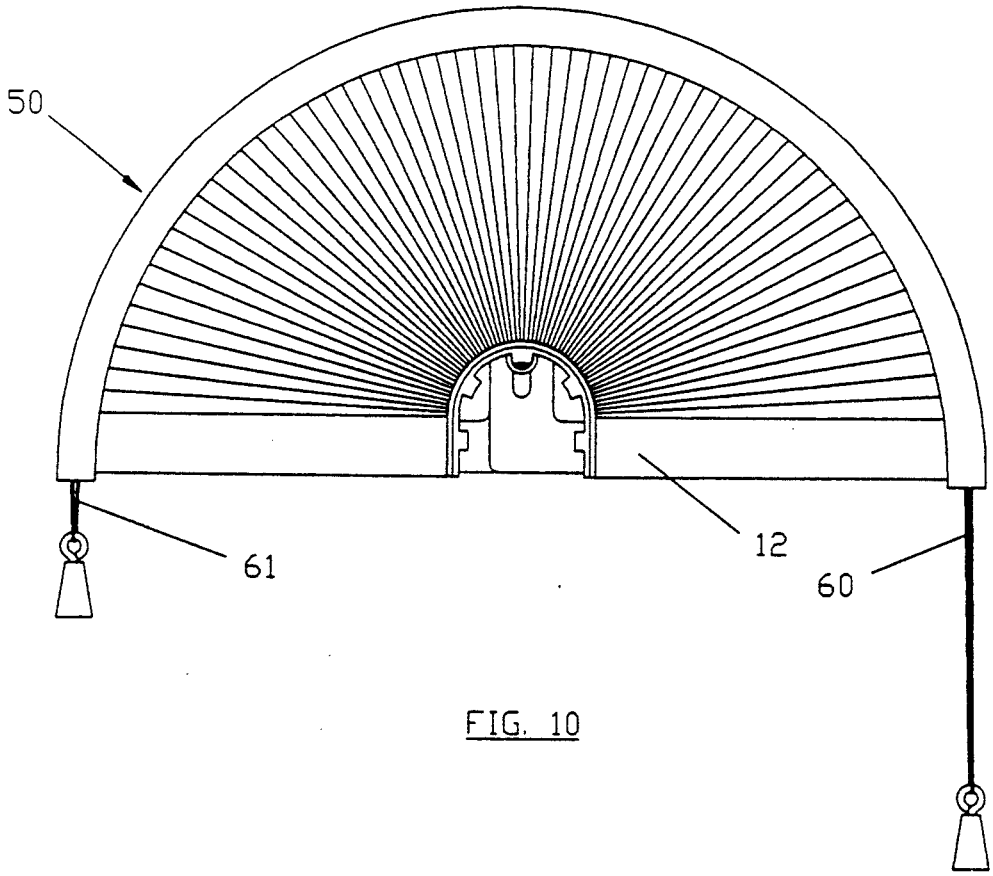
FIG. 10 is a front view of the embodiment of FIG. 1 in a present preferred track.
Figure 11:
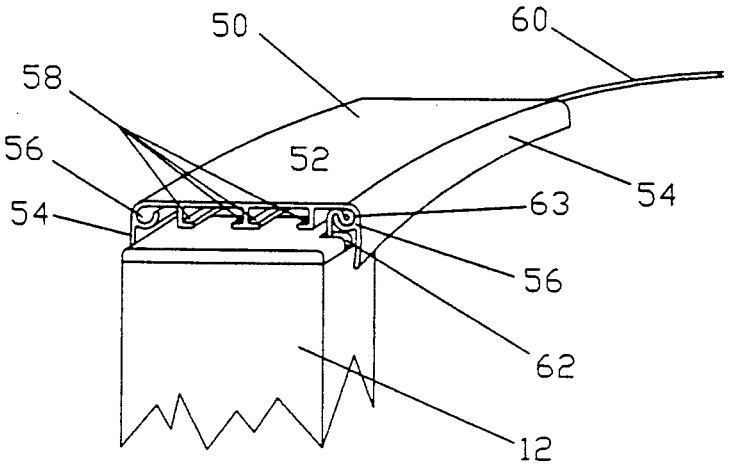
FIG. 11 is a perspective view of a portion of the blind and track of FIG. 10.
Figure 12:
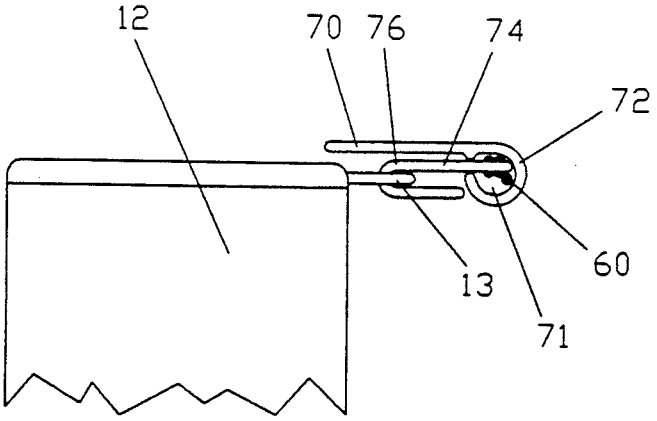
FIG. 12 is an end view of a second present preferred track and portion of a blind having a releasable coupling therein.

As shown in FIGS. 10 and 11, we prefer to provide a generally U-shaped track 50 having a base 52 and edges 54. Edges 54 are sufficiently large to fit over a portion of bars 12 and 14 and the blind panel attached therebetween. In at least one corner of the track, we provide a cord carrying channel 56 through which cords 60 and 61 travel. A knot 63 is made along cord 60. Knot 63 is placed within cord carrying channel 56, thereby retaining cord 60 within channel 56. One end of both cords is attached to an end of one bar 12 by any convenient means as indicated at point 62. Preferably, cord 60 is knotted at its end and that knot is placed within bar 12. The opposite end of the cord 60 can be attached to the frame to create a loop as shown in FIG. 10 or may hang free. The cord 60 could also be mounted on a track 70 through a cord carrier 74 which rides on the track 70 and is removably attached to a rail. Such a carrier is shown in the embodiment of FIG. 12. To open the blind one simply pulls the first cord 60 which pulls bar 12 to an open position. As bar 12 moves it retracts cord 61 into the track. To close the blind one pulls cord 61 which moves bar 12 toward bar 14. Thus when the blind is open a long portion of cord 60 will be exposed and a short portion of cord 61 is exposed. When the blind is closed, a long portion of cord 61 is exposed, but only a short portion of cord 60 is exposed. We also prefer to provide guides 58 within the track 50. The track is preferably made of clear or light colored plastic so as to be not readily seen. Additionally, the track should have some flexibility to conform to an arch shaped window frame. The track is attached to the frame in any conventional manner such as nails, screws and glue.

In FIG. 12 we show a second present preferred track 70 having a single cord carrying channel 71. We prefer to provide a cord carrier 74 which rides in channel 71 and has a cord 60 attached thereto. The cord carrier 74 has a coupling 76 which is releasably connected to a mating coupling 13 attached to bar 12. This coupling arrangement enables one to install the track 70 and cord 60 without the blind being present. Then, one can place the blind into the track and readily attach the cord to the blind.

Figure 13:
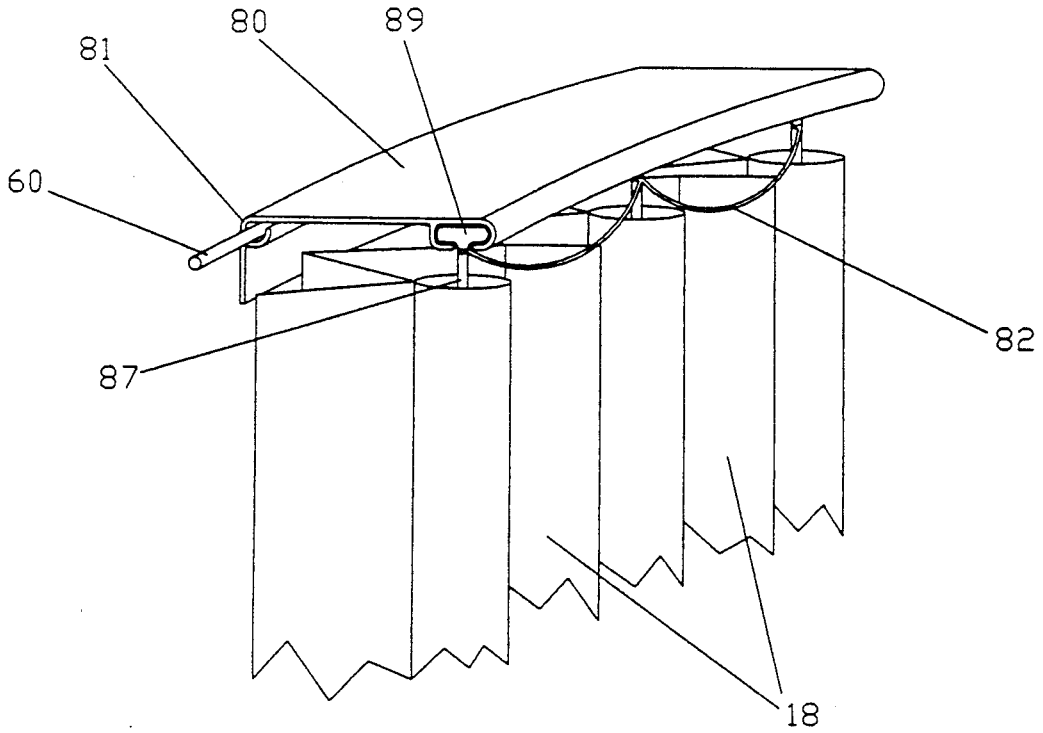
FIG. 13 is a rear perspective view partially cut away of a third present preferred track having a fabric carrier and a spacer.

As shown in FIG. 13, we may also provide yet another track 80 having fabric carriers 89 which ride in a second channel 83 opposite the cord carrying channel 81. Pins 87 extend from each carrier into selected locations in the fabric. Preferably the pins 87 are connected to the fabric or to the support rods 17 shown in FIGS. 7 and 8. In order to maintain spacing between the carriers 89, we prefer to provide a spacer cord 82 which runs between adjacent pins. The spacer cord will pull the pins 87 and attached carriers 89 like a chain gang along the track whenever the blind is opened and closed. In the absence of a spacer cord fabric 18 would pull the pins and carriers during opening and closing of the blind. Such pulling of fabric could cause flattening of the pleats or other undesirable distortion of the fabric.

Figure 14:
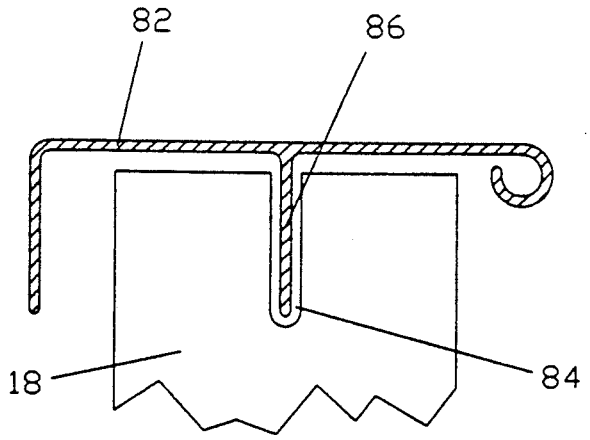
FIG. 14 is a cross-sectional view of a fourth present preferred track having a slot in the blind and a guide on the track.

An alternative way to support the fabric against transverse movement is provided in the track 85 shown in FIG. 14. That track contains a flange 86 which extends into a slot 84 through the fabric. Flange 86 preferably runs the full length of track. At least one of the bars 12 and 14 attached to the ends of the fabric must have a slot comparable to slot 84 to allow the bar to travel along the track.

While we have shown and described certain preferred embodiments of our invention, it should be distinctly understood that the invention is not limited thereto, but may be variously embodied within the scope of the following claims.

We claim:

1. An improved operable arch blind, comprising:

a first elongated, rigid bar and a second elongated rigid bar, each said bar having a bottom end, an inner face and an outer face, an arcuately collapsible, pleated blind panel having a bottom end, a top end, a first side, and a second side, the first side of said blind panel being fixed to the inner face of said first bar, the second side of said blind panel being fixed to the inner face of said second bar, and a pivot means comprised of a first hinge segment, a second hinge segment, and a pin, said first hinge segment being generally L-shaped and having a portion that is fixed to said first bar and a portion extending away from said first bar, said portion lying away from said first bar having a slot, said second segment being generally L-shaped and having a portion that is fixed to said second bar and a portion lying away from said second bar, said portion lying away from said second bar having a slot, said first hinge segment and said second hinge segment are oriented so that the slot of said first hinge segment overlaps the slot of said second hinge segment, said pin passing through said slots.

2. The blind of claim 1 also comprising:

a flexible link having a top side, an underside and two opposed ends, one end of said flexible link being fixed to the bottom end of said first bar, an opposite end of said flexible link being fixed to the bottom end of said second bar and the top side being adhesively attached tot he bottom end of said panel.

3. The improved blind of claim 2 wherein said flexible link if fixed to said first bar and said second bar by two U-shaped clips, each clip having a flat portion and two parallel portions extending out from said flat portion, said flat portions lying lightly against said flexible link and said parallel portions being fixed to said bar.

4. The improved blind of claim 3 wherein the underside of said flexible link has a plurality of spaced grooves lying perpendicular to the length of said flexible link so that each of said flat portions of said clips lie within one of said grooves.

5. The improved blind of claim 1 wherein said blind panel is made of a metallized fabric.

6. The blind of claim 1 also comprising a track for carrying at least one of said first and second bars and blind panel therebetween, said track having a base and at least one side extending from said base, and forming a corner with said base and a channel provided along at least one corner sized to accommodate a cord, and at least one cord a portion of which is placed within said channel and having one end attached to one of said first and second bars.

7. The blind of claim 1 also comprising a plurality of stabilizing rods attached to said pleated blind.

8. The blind of claim 1 also comprising at least one of a magnet and magnetic tape attached to at least one rail.

9. The blind of claim 1 wherein a portion of the pleated blind panel is extended over an outer face of at least one rail.

10. The blind of claim 6 wherein a first cord is attached to one bar and a second cord is attached to the same bar.

11. The blind of claim 6 also comprising a cord carrier positioned within the said track and attached to said cord and one of said first and second bars.

12. The blind of claim 6 wherein said carrier and said one of said first and second bar are attached with a releasable coupling.

13. The blind of claim 6 also comprising a plurality of stabilizing rods attached to said pleated blind.

14. The blind of claim 13 also comprising at least one fabric carrier connected to at least one stabilizing rod.

15. The blind of claim 14 also comprising a spacer cord connected between a plurality of said fabric carriers and attached stabilizing rods.

16. The blind of claim 6 also comprising a guide attached to and running along the track, the guide sized and positioned to extend into a slot provided in the blind.

17. An improved operable arch blind, comprising:

a first elongated, rigid bar and a second elongated rigid bar, each said bar having a bottom end, an inner face and an outer face, an arcuately collapsible, pleated blind panel having a bottom end, a top end, a first side, and a second side, the first side of said blind panel being fixed to the inner face of said first bar, the second side of said blind panel being fixed to the inner face of said second bar, a track for carrying at least one of said first and second bars and blind panel therebetween, said track having a base and at least one side extending from said base, and forming a corner with said base and a channel provided along at least one corner sized to accommodate a cord, and at least one cord, a portion of which is placed within said channel and having one end attached to one of said first and second bars.

* * * * *

UNITED STATES PATENT AND TRADEMARK OFFICE

CERTIFICATE OF CORRECTION

PATENT NO. : 5,168,912

DATED : December 8, 1992

INVENTOR(S) : RALPH JELIC, REN JUDKINS

It is certified that error appears in the above-identified patent and that said Letters Patent is hereby corrected as shown below:

Column 1, line 22, after "such" insert --as--.

Column 5, line 62, change "tot he" to --to the--.

Column 5, line 64, change "if" to --is--.

Signed and Sealed this

Second Day of November, 1993

*Attest:*

*Attesting Officer*

Bruce Lehman

BRUCE LEHMAN

*Commissioner of Patents and Trademarks*